United States Patent [19]

Nihei et al.

[11] Patent Number: 4,499,748

[45] Date of Patent: Feb. 19, 1985

[54] ROLLING MILL

[75] Inventors: Mitsuo Nihei; Hidetoshi Nishi, both of Hitachi, Japan

[73] Assignee: Hitachi, Ltd., Tokyo, Japan

[21] Appl. No.: 456,106

[22] Filed: Jan. 6, 1983

[30] Foreign Application Priority Data

Jan. 6, 1982 [JP] Japan ..... 57-265
Jan. 22, 1982 [JP] Japan ..... 57-7645

[51] Int. Cl.[3] ..... B21B 31/08; B21B 31/18; B21B 29/00

[52] U.S. Cl. ..... 72/238; 72/243; 72/247; 72/249

[58] Field of Search ..... 72/241, 243, 245, 247, 72/249, 238, 239

[56] References Cited

U.S. PATENT DOCUMENTS 3,818,743 6/1974 Kajiwara et al. ..... 72/243
4,194,382 3/1980 Kajiwara ..... 72/243
4,369,646 1/1983 Kajiwara ..... 72/243

FOREIGN PATENT DOCUMENTS 1101702 5/1981 Canada ..... 72/241

*Primary Examiner*—Francis S. Husar
*Assistant Examiner*—Steven B. Katz
*Attorney, Agent, or Firm*—Beall Law Offices

[57] ABSTRACT

A rolling mill comprising a roll housing in which are mounted a pair of work rolls which can be bent by work roll benders and a pair of support rolls therefor which are displaceable relative to each other in their axial direction and are bent by support roll benders. To minimize the size of the window of the rolling mill housing while including a plurality of mechanisms such as roll benders and means for roll displacement, said support roll benders are disposed closer to the center plane of the rolling mill than the work roll benders.

15 Claims, 4 Drawing Figures

ROLLING MILL

BACKGROUND OF THE INVENTION

1. Field of the Invention

This invention relates to a rolling mill for producing metal sheet having rolls displaceable in the axial direction for control of the cross-sectional shape of rolled sheet in rolling.

2. Description of the Prior Art

A rolling mill, which has rolls displaceable in the axial direction and means for applying roll bending forces at the ends of the rolls, has been proposed by the assignee of the present inventors in U.S. Pat. No. 4,369,646. Such a mill is effective in correcting the shape or improving the sectional profile of rolled sheet. U.S. Pat. No. 4,369,646 describes a six-high rolling mill of which intermediate rolls (i.e. rolls between the work rolls and the backup rolls) are displaceable in the axial direction into a staggered relationship in which they overlap one another by an amount dependent on the width of the sheet and are bent by forces applied to the roll chocks, that is by roll bending forces. In this reference it is also disclosed that addition of a work roll bender to bend the work roll axis is required to improve the shape of the sheet further.

However it is difficult to dispose a plurality of roll benders inside the window of the rolling mill housing without enlarging the size of the window and as a result the roll housing. Accordingly, in practice, there has not yet been found a solution to this problem.

SUMMARY OF THE INVENTION

One object of the invention is to provide a rolling mill in which are disposed roll benders for two sorts of rolls without requiring an excessive size of the window of the roll housing.

According to the invention roll benders for rolls displaceable in the axial direction are disposed closer to the centre plane of the rolling mill than roll benders for other rolls. By "centre plane", we mean the plane containing the axes of the work rolls. This invention makes it possible to avoid enlarging the window because the above mentioned two sorts of benders do not interfere with one another and thus makes it possible to provide a convenient mechanism for adjusting the axial position of displaceable rolls. Preferably, in a six-high rolling mill, the intermediate rolls are chosen as the displaceable rolls bent by roll benders, and the working rolls are the said other rolls bent by other roll benders in order to improve the correction of the shape of the sheet.

BRIEF DESCRIPTION OF THE DRAWINGS

Other advantages and optional features of the invention will be described in more detail with reference to preferred embodiments illustrated in the accompanying drawings, in which.

DESCRIPTION OF THE PREFERRED EMBODIMENTS

Figure 1:
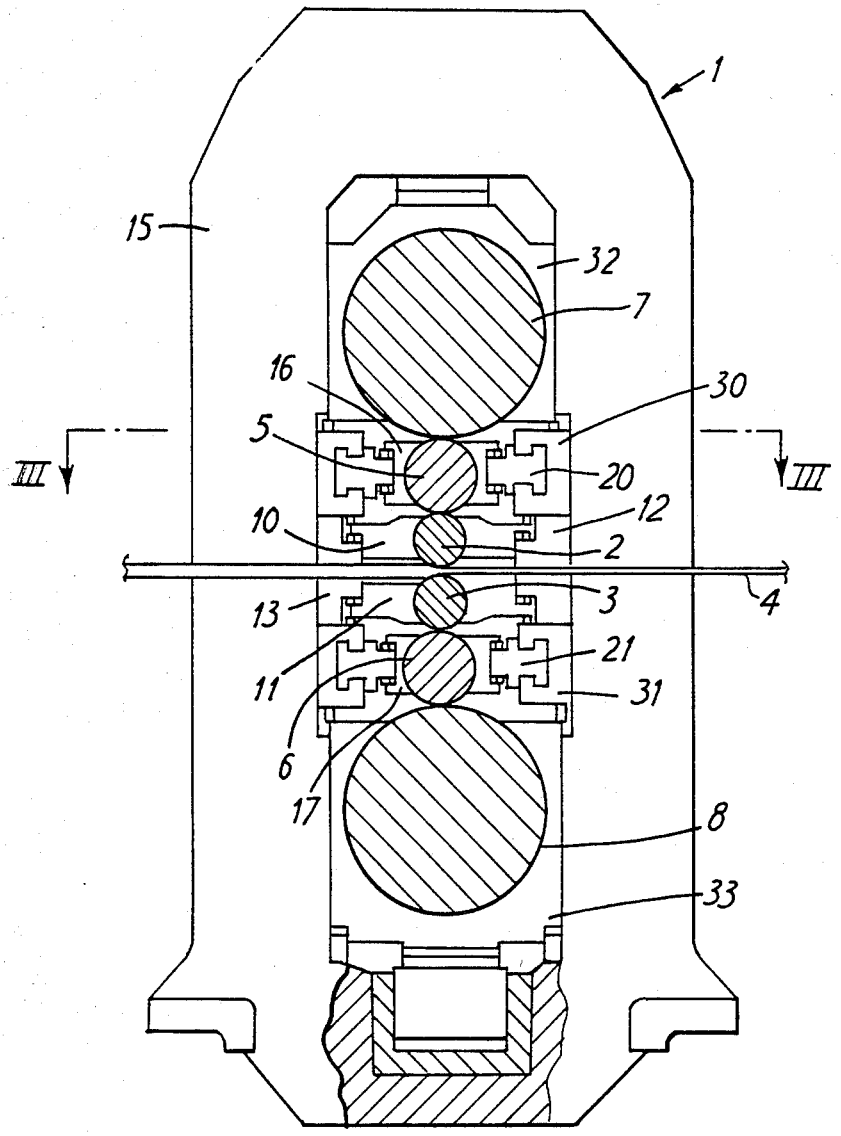
FIG. 1 is a schematic view of a rolling mill in accordance with the present invention.
Figure 2:
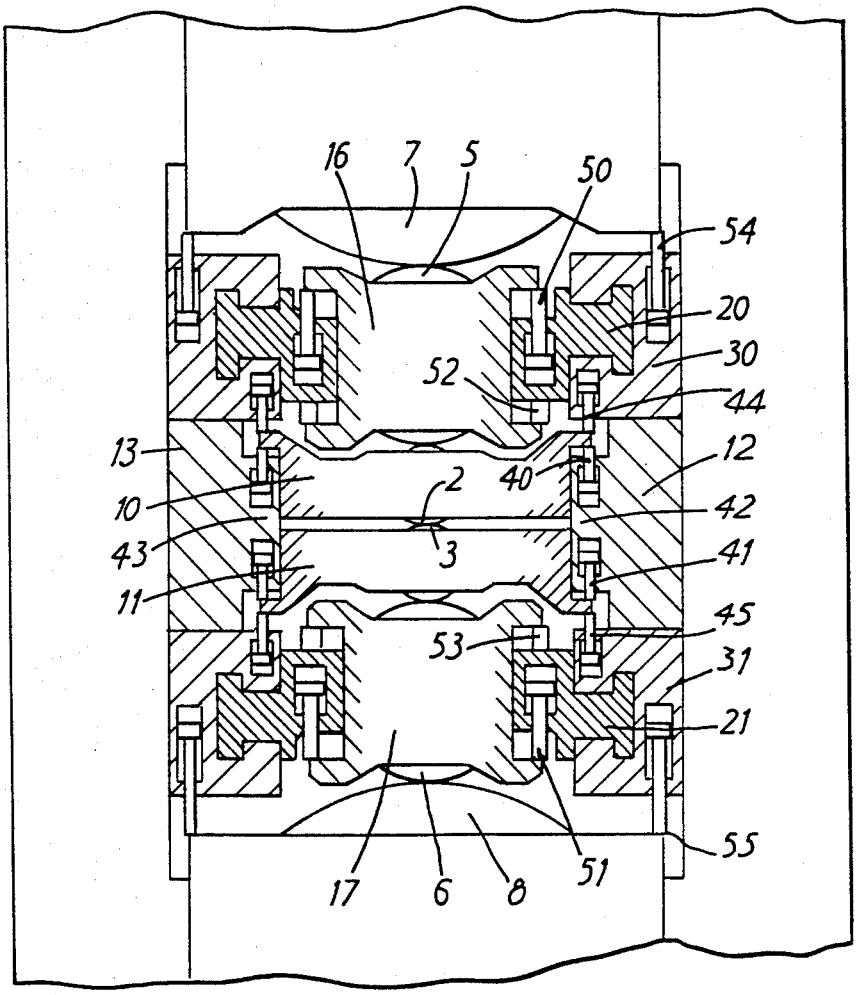
FIG. 2 is a partial enlarged view of FIG. 1.

In FIG. 1 and FIG. 2, there is illustrated a six-high rolling mill 1 which comprises a pair of work rolls 2,3 which in use contact roll the sheet 4 being worked, a pair of intermediate rolls 5,6 disposed in contact with and above and below the work rolls 2,3 respectively, and a pair of backup rolls 7,8 disposed in contact with and above and below the intermediate rolls 5,6 respectively so as to support the intermediate rolls 5,6. Both the intermediate rolls 5,6 and the backup rolls 7,8 act as support rolls for the work rolls 2,3.

In this embodiment as described below, the intermediate rolls are relatively axially displaceable into a staggered relationship.

The end portions of the work rolls 2,3 are rotatably supported by work roll chocks 10,11 which are supported by a pair of so-called project blocks 12,13 mounted in the window of the roll housing 15. The project blocks 12,13 are so-called because they project inwardly from the roll-housing 15. The chocks 10,11 are vertically displaceable relatively to the blocks 12,13 in dependence on the rolling forces on them during operation.

The end portions of intermediate rolls 5,6 are supported rotatably by intermediate roll chocks 16,17 respectively. These chocks 16,17 are, like the work roll chocks, supported but movable vertically in movable blocks 20, 21 which can move in the direction parallel to the roll axes along slots formed in another pair of project blocks 30,31. These project blocks 30,31 are removably mounted in the window and above and below the project blocks 12,13 respectively. The side faces of the chocks 16,17 are located at a position closer to the centre plane of the rolling mill housing than the side faces of the work roll chocks 10,11. This layout enables the intermediate roll chocks 16,17 to move smoothly vertically and makes the movement of the movable blocks 20,21 stable.

The end portions of the highly rigid backup rolls 7,8 are supported rotatably by chocks 32,33 which are mounted in and displaceable vertically along the inside faces of the windows of the rolling mill frame.

The work rolls 2,3 are given increased bending by roll benders in the form of hydraulic rams 40,41 which are formed in inward projections 42,43 of the project blocks 12,13. Roll benders in the form of hydraulic rams 44,45 for applying decreased bending to the work rolls 2,3 are formed in the project blocks 30,31.

The intermediate rolls 5,6 are bent by hydraulic increase bending rams 50,51 and by hydraulic decrease bending rams 52,53 formed in the movable blocks 20,21. See also FIG. 3 for the location of these roll benders 50–53. Further there are provided hydraulic rams 54,55 which are formed in the project blocks 30,31 and serve as rams for balancing the backup rolls 7,8.

Figure 3:
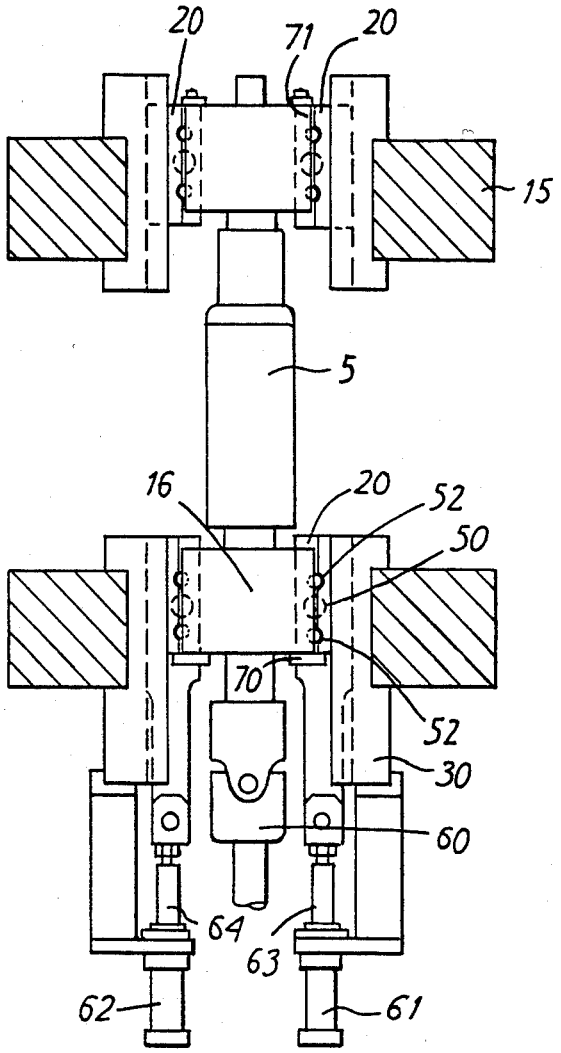
FIG. 3 is a sectional view taken along line III—III of FIG. 1.

As shown in FIG. 3, the upper intermediate roll 5 is driven rotatably through a spindle coupling 60 by driving means (not shown). There are provided a pair of hydraulic cylinders 61,62 which are disposed on the project blocks 30 at the same side of the rolling mill as the coupling 60 i.e. at the driving side, and are located horizontally at both sides of the spindle coupling 60. The cylinders 61,62 move rods 63,64 connected to the movable blocks 20. The chocks 16 and the movable blocks 20 supported by the project blocks 30 are connected to each other by keeper plates 70, 71 at both the driving side of the rolling mill and at the opposite side i.e. the operating side of the rolling mill. Therefore, by operating the cylinders 61,62 it is possible to make the movable blocks 20, the chocks 16 at both sides of the rolling mill and the intermediate roll 5 move together in the axial direction of the roll. The intermediate bending rams 50,52 formed in the movable blocks 20 move with the chocks 16 at the same time, so it is possible to exert a force towards the centre of chocks 16 by choosing a desired position of the hydraulic rams 50,52 wherever the intermediate roll 5 is located. Although the above explanation mainly relates to the upper intermediate roll 5 the same applies for the lower intermediate roll 6.

On the other hand, when changing the rolls 5,6 the assembly of the intermediate rolls 5,6 and chocks 16,17 therefore can be drawn out from the rolling mill leaving the movable blocks 20,21 inside the rolling mill 1 by releasing the connection of the movable blocks 20,21 and the chocks 16,17 by removing keeper plates 70,71 which in operation maintain the axial position of the chocks on the movable blocks.

Accordingly, in this embodiment, the intermediate rolls 5,6 can be displaced in dependence on the width of the rolled sheet, while the intermediate roll bending means 50,51,52,53 and the work roll bending means 40,41,44,45 can act suitably on the respective rolls 5,6 and 2,3 so that it is possible to maintain a high ability to correct shape of the rolled product. In this embodiment also, since they are at the central or inner sides of the movable blocks 20,21 the intermediate roll benders 50,51,52,53 are located closer to the center plane of the rolling mill than the work mill benders 40,41,44,45 which are located further from the centre plane of the rolling mill. This is achieved by arranging the work roll benders in two types of project blocks 12,13 and 30,31. This layout means that the size of the window of the housing can be kept suitably small, while a high ability to correct shape is maintained.

Furthermore, the means for adjustment of the axial position of the intermediate rolls are mounted at the driving side of the rolling mill. Therefore the space at the operating side is maintained large enough, for instance, to permit roll changing. Also, all the movable blocks 20,21 can be left inside the rolling mill during roll changing. As a result, exchanging of rolls can be performed very easily.

It should also be noted that adjustment means for the intermediate rolls, i.e. the movable blocks 20,21 and the cylinders 61,62 for moving the movable blocks 20,21 are provided on both sides of the chocks 16,17 at the driving side, leaving space at the axis of each intermediate roll for the driving spindle coupling. Therefore, in this embodiment the means for moving the intermediate rolls axially are simple in construction and connection or disconnection of the drive spindle to intermediate rolls is easy.

Figure 4:
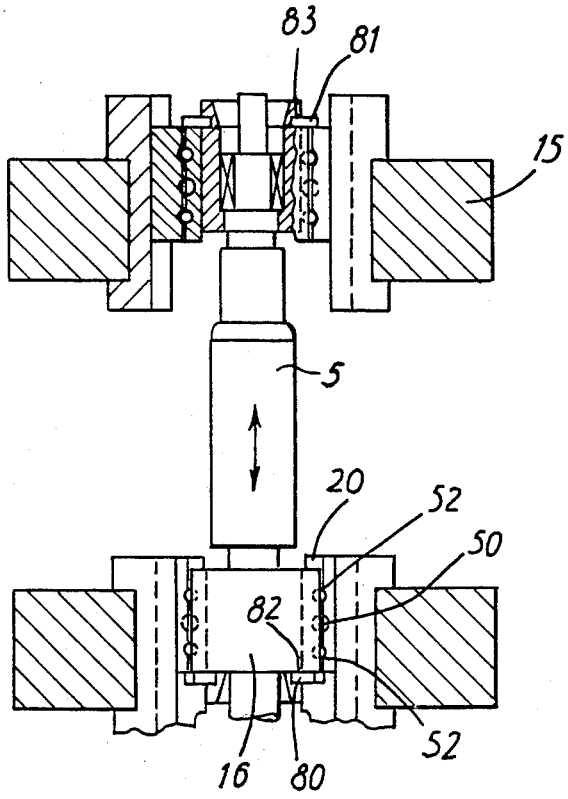
FIG. 4 is a sectional view, corresponding to FIG. 3, of another embodiment.

FIG. 4 illustrates another embodiment of the means for connection and release of the movable blocks 20 and chocks 16. Each movable block 20 carries a keeper plate 80,81 which is horizontally movable so as to be inserted in a laterally directed slot 82,83 formed in the chock 16. These keeper plates 80,81 are inserted in or released from the slots 82,83 automatically by means (not shown) for moving the keeper plates 80,81. In this embodiment rapid exchanging of rolls is made possible because connection or disconnection of the movable blocks 20 and chocks 16 is easy.

In the above specific embodiments, the roll benders consist of rams, the intermediate roll benders are formed in the movable blocks and the rolling mill is a six-high mill. However, the invention is not limited in these respects, and for instance, the roll benders can consist of other mechanisms, the intermediate roll benders may be mounted on the project blocks and the rolling mill may be other than a six roll mill. For instance in a four-high mill, the backup rolls are axially relatively displaceable into a staggered relationship.

What is claimed is:

1. A rolling mill, comprising:

a roll housing;

a pair of work rolls having parallel axes and being mounted within said roll housing;

work roll chocks mounted within said roll housing and supporting respective opposite ends of said work rolls;

a pair of intermediate rolls mounted on parallel axes within said roll housing for engaging and supporting said work rolls;

intermediate roll chocks mounted within said roll housing and supporting respective opposite ends of said intermediate rolls;

a pair of backup rolls mounted within said roll housing for contacting and supporting said intermediate rolls;

intermediate roll benders for bending said intermediate rolls;

work roll benders in said roll housing and engaging said work roll chocks for bending said work rolls;

said intermediate roll chocks and said work roll chocks having laterally, with respect to said roll axes, outermost faces;

said intermediate roll chock outermost faces and roll benders being closer to the centre plane of the rolling mill than said work roll chock outermost faces and work roll benders;

drive means having two drive shafts respectively axially connected to and to rotate each intermediate roll, and said drive means being located on only one axial side of said roll housing;

means for causing relative axial displacement of the intermediate rolls relative to each other and said roll housing, comprising movable blocks separately mounted within said roll housing on opposite sides of each intermediate roll to be displaceable in the axial direction of the intermediate rolls inside the roll housing, and said movable blocks supporting said intermediate roll chocks while permitting them to move vertically;

disconnectable means connecting the movable blocks and the intermediate roll chocks to move together in the axial direction during said axial displacement and to disconnect for permitting roll change on the opposite axial side of said roll housing;

said means for moving the movable blocks being on said one axial side of said roll housing with said drive means and further comprising, for each intermediate roll, a pair of cylinders operatively connected to said movable blocks for reciprocating them in the axial direction and said pair of cylinders being located on opposite sides of the associated one of said drive shafts; and said intermediate roll benders being provided operatively between said movable blocks and said intermediate roll chocks.

2. A rolling mill according to claim 1 wherein said intermediate roll benders consist of increase benders and decrease benders.

3. A rolling mill according to claim 1, further including:

first project blocks mounted on the roll housing and supporting said work roll chocks for slidable, vertical movement therebetween;

second project blocks mounted on the roll housing and supporting said movable blocks with horizonally slidable movement therebetween in the axial direction of said rolls, respectively above and below said first project blocks; and said first and said second project blocks each having mounted therein said work roll benders.

4. A rolling mill according to claim 3, wherein some of said work roll benders are mounted within said first project block for bending respective work rolls in one direction and the remaining of said work roll benders are mounted in said second project blocks for bending respective work rolls in the other direction.

5. A rolling mill according to claim 4, further including backup roll chocks mounting opposite ends of respective backup rolls and being mounted for vertical movement on said roll housing;

balance ram means being mounted within said second project blocks laterally, with respect to the roll axes, outwardly of said movable blocks for engaging and selectively moving said backup roll chocks vertically within said roll housing.

6. A rolling mill according to claim 5, wherein said intermediate roll benders are respectively contained in two parallel planes on opposite sides of the mill centre plane and for each axial end of each intermediate roll in one plane consist of a first ram for bending its intermediate roll in one direction and second and third rams equally spaced axially from and on opposite sides of said first ram for bending said intermediate rolls in the opposite direction.

7. A rolling mill according to claim 6, wherein said disconnectable means for connecting comprise keeper plate means for axially locating the intermediate roll chocks on the movable blocks for axial movement together, and said keeper plate means being removable so that the assembly of an intermediate roll and its intermediate roll chocks may be axially withdrawn from and without moving the assembly of corresponding said movable blocks and intermediate roll benders.

8. A rolling mill according to claim 3, further including backup roll chocks mounting opposite ends of respective backup rolls and being mounted for vertical movement on said roll housing;

balance ram means being mounted within said second project blocks laterally, with respect to the roll axes, outwardly of said movable blocks for engaging and selectively moving said backup roll chocks vertically within said roll housing.

9. A rolling mill according to claim 8, wherein said intermediate roll benders are respectively contained in two parallel planes on opposite sides of said centre plane and for each axial end of each intermediate roll in one plane consist of a first ram for bending its intermediate roll in one direction and second and third rams equally spaced axially from and on opposite sides of said first ram for bending said intermediate rolls in the opposite direction.

10. A rolling mill according to claim 9, wherein said disconnectable means for connecting comprise keeper plate means for axially locating the intermediate roll chocks on the movable blocks for axial movement together, and said keeper plate means being removable so that the assembly of an intermediate roll and its intermediate roll chocks may be axially withdrawn from and without moving the assembly of corresponding said movable blocks and intermediate roll benders.

11. A rolling mill according to claim 3, wherein said intermediate roll benders are respectively contained in two parallel planes on opposite sides of said centre plane and for each axial end of each intermediate roll in one plane consist of a first ram for bending its intermediate roll in one direction and second and third rams equally spaced axially from and on opposite sides of said first ram for bending said intermediate rolls in the opposite direction.

12. A rolling mill according to claim 3, wherein said disconnectable means for connecting comprises keeper plate means for axially locating the intermediate roll chocks on the movable blocks for axial movement together, and said keeper plate means being removable so that the assembly of an intermediate roll and its intermediate roll chocks may be axially withdrawn from and without moving the assembly of corresponding ones of said movable blocks and intermediate roll benders.

13. A rolling mill according to claim 1, wherein said disconnectable means for connecting comprises keeper plate means for axially locating the intermediate roll chocks on the movable blocks for axial movement together, and said keeper plate means being removable so that the assembly of an intermediate roll and its intermediate roll chocks may be axially withdrawn from and without moving the assembly of corresponding ones of said movable blocks and intermediate roll benders.

14. A rolling mill according to claim 13, wherein said intermediate roll chocks include slots opening in the direction laterally of said roll axes; and said keeper plate means being mounted on said movable blocks to be insertable in and removable from said slots.

15. A rolling mill according to claim 1 wherein said intermediate roll chocks include slots opening in the direction laterally of the roll axes; and said keeper means being mounted on said movable blocks to be insertable in and removable from said slots.

* * * * *